US006525016B2

(12) United States Patent
Liew

(10) Patent No.: US 6,525,016 B2
(45) Date of Patent: Feb. 25, 2003

(54) BLEND OF IMIDAZOLINIUM QUAT AND AMIDO AMINE QUAT FOR USE IN FABRIC SOFTENERS WITH PREMIUM SOFTENING, HIGH-VISCOSITY AT LOW-SOLIDS AND NON-YELLOWING PROPERTIES

(75) Inventor: Jen Farn Liew, Toa Payoh (SG)

(73) Assignee: Goldschmidt Chemical Corporation, Hopewell, VA (US)

( * ) Notice: Subject to any disclaimer, the term of this patent is extended or adjusted under 35 U.S.C. 154(b) by 0 days.

(21) Appl. No.: 09/760,945

(22) Filed: Jan. 16, 2001

(65) Prior Publication Data

US 2002/0094943 A1 Jul. 18, 2002

(51) Int. Cl.[7] ..... C11D 3/00
(52) U.S. Cl. ..... 510/522; 510/527
(58) Field of Search ..... 510/522, 527

(56) References Cited

U.S. PATENT DOCUMENTS 4,439,335 A * 3/1984 Burns ..... 252/8.75
4,711,730 A * 12/1987 Gosselink et al. ..... 252/8.75
4,994,193 A * 2/1991 Wahl ..... 252/8.8
6,024,943 A * 2/2000 Ness et al. ..... 424/59

* cited by examiner

*Primary Examiner*—John Hardee
(74) *Attorney, Agent, or Firm*—Scully, Scott, Murphy & Presser

(57) ABSTRACT

A high-viscosity, low-solids rinse cycle fabric softener formulation including a homogeneous blend of (a) 50–90% by weight of at least one imidazolinium quaternary ammonium compound; and (b) 10–50% by weight of at least one amido amine quaternary ammonium compound, wherein said at least one imidazolinium quaternary ammonium compound and said at least one amido amine quaternary ammonium compound do not contain any unsaturated alkyl groups, dispersed in water. A method of preparing the high-viscosity, low-solids rinse cycle fabric softener formulation is also provided.

22 Claims, No Drawings

BLEND OF IMIDAZOLINIUM QUAT AND AMIDO AMINE QUAT FOR USE IN FABRIC SOFTENERS WITH PREMIUM SOFTENING, HIGH-VISCOSITY AT LOW-SOLIDS AND NON-YELLOWING PROPERTIES

FIELD OF THE INVENTION

The present invention relates to fabric softners, and more particularly to a low-solids rinse cycle fabric softener formulation having enhanced viscosity, softening and non-yellowing properties. Specifically, the present invention relates to a high-viscosity, low-solids rinse cycle fabric softener formulation which includes a blend of at least one imidazolinium quaternary ammonium compound and at least one amido amine quaternary ammonium compound.

BACKGROUND OF THE INVENTION

In the field of laundering, it is well known to add a liquid fabric softener containing at least one softening agent such as a cationic quaternary ammonium compound or salt thereof directly into the laundering process. The addition of the liquid fabric softener typically occurs during the rinse cycle itself.

Rinse cycle fabric softeners are provided in two forms: concentrated (i.e., high-solids) compositions containing more than 10% by weight of fabric softener agents, and diluted (i.e., low-solids) compositions containing 10% by weight of fabric softener agents. Consumer acceptance of rinse cycle fabric softeners is determined not only by the performance achieved with these products, but also by the aesthetics associated therewith. For example, high-viscosity fabric softeners (having a viscosity on the order of 500 cps or higher) are perceived by some consumers to be superior to low-viscosity fabric softeners. Viscosity of the rinse cycle fabric softener is therefore an important aspect of the successful formulation of such commercial products.

In attempts to increase the viscosity of low-solids fabric softeners, it is known to add polymeric thickening agents such as polyacrylamides, polysaccharides and polyurethanes to the fabric softener formulation. Large quantities of thickening agents are typically required in order to provide effective thickening of low-viscosity fabric softeners. While the use of such high quantities of thickening agents would provide a solution to the viscosity problem, this solution leads to increased cost in formulating the fabric softener which cost is passed along to the consumer.

This increased formulation cost is further compounded in that conventional polymeric thickening agents provide no additional benefits to the fabric softener formulation. Thus, additional ingredients besides thickening agents which further enhance the formulation performance are typically required.

In view of the above drawbacks with the prior art mentioned above, it would be beneficial to provide a new and cost effective means for improving the viscosity of low-solids rinse cycle fabric softeners which do not require the use of conventional polymeric thickeners.

SUMMARY OF THE INVENTION

The present invention relates to a high-viscosity, low-solids rinse cycle fabric softener formulation having enhanced softening and non-yellowing properties. The enhancement is achieved in the present invention by providing a blend of at least one imidazolinium quaternary ammonium compound and at least one amido amine quaternary ammonium compound, wherein both quaternary compounds contain no unsaturated alkyl groups.

The term "high-viscosity" fabric softener is used herein to denote a fabric softener having a viscosity on the order of about 500 cps or greater, whereas the term "low-viscosity" fabric softener denotes a fabric softener having a viscosity of below about 500 cps.

The term "high-solids" fabric softener denotes a fabric softener formulation in which the fabric softening compound, i.e., the quaternary ammonium compound, is present in an amount of greater than 10% by weight, whereas the term "low-solids" denotes a fabric softener formulation in which the fabric softener component is present in an amount of about 10% by weight or less, preferably, about 1 to about 10% by weight, and even more preferably, about 2 to about 5% by weight.

Specifically, the present invention provides a high-viscosity, low-solids rinse cycle fabric softener formulation having improved softening and non-yellowing properties, which comprises a homogeneous blend of from about 50 to about 90% by weight of at least one imidazolinium quaternary ammonium compound; and from about 10 to about 50% by weight of at least one amido amine quaternary ammonium compound, wherein said at least one imidazolinium quaternary ammonium compound and said at least one amido amine quaternary ammonium compound do not contain any unsaturated alkyl groups. These constituents are dispersed in water, which may preferably have a conductivity of about 2 $\mu$S/cm or below and a hardness of about 1 ppm $CaCO_3$ or below. It is noted that the above mentioned values for conductivity and softness are exemplary, and by no means limit the scope of the present invention.

The high-viscosity, low-solids rinse cycle fabric softener formulation of the present invention is used in the rinse cycle of any laundering process wherein conventional detergents are employed. The rinse cycle fabric softener formulation of the present invention is used in an amount of from about 0.05 to about 0.4 weight % of said fabric softener formulation, per 100 grams of fabric to be laundered.

In accordance with another aspect of the present invention, a method of preparing the above mentioned high-viscosity, low-solids rinse cycle fabric softener formulation is provided. Specifically, the inventive method comprises blending from about 50 to about 90% by weight of at least one imidazolinium quaternary ammonium compound with from about 10 to about 50% by weight of at least one amido amine quaternary ammonium compound, wherein said at least one imidazolinium quaternary ammonium compound and said at least one amido amine quaternary ammonium compound do not contain any unsaturated alkyl groups. These compounds are dispersed in water at a temperature of from about 30° to about 70° C., wherein said water preferably has a conductivity of about 2 $\mu$S/cm or below and a hardness of about 1 ppm $CaCO_3$ or below.

DETAILED DESCRIPTION OF THE INVENTION

As stated above, the present invention relates to a high-viscosity, low-solids rinse cycle fabric softener formulation which includes at least one imidazolinium quaternary ammonium compound and at least one amido amine quaternary ammonium compound, wherein both quaternary compounds contain no unsaturated alkyl groups present therein.

The term "imidazolinium quaternary ammonium compound" is used herein to denote a quaternary ammonium compound having the following formula:

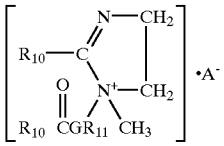

wherein $R_{10}$ is an saturated $C_{11-21}$ alkyl; $R_{11}$ is a divalent $C_{1-6}$ alkyl group; G is O or NH; and A is chloride, bromide, methyl sulfate, ethysulfate, formate, acetate, carbonate, sulfate, nitrate and other like anions. Preferred anions are chloride and methyl sulfate. Examples of imidazolinium quats that can be employed in the present invention include, but are not limited to: Varisoft 445 (i.e., methyl-1-hydrogenated tallow imidazolinium methyl sulfate) supplied by Goldschmidt Chemical Company.

The term "amido amine quaternary ammonium compound" is used herein to denote a quaternary ammonium compound having the following formula:

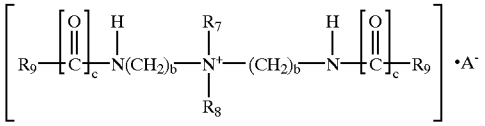

wherein $R_7$ is hydrogen or a $C_{1-4}$ alkyl; $R_8$ is a $C_{1-4}$ alkyl, ethoxy or propoxy; each $R_9$ is the same or different and is a saturated $C_{7-27}$ alkyl; c is 0 or 1; b is 1 to 6; and A is one of the above mentioned anions. Examples of amido amine quats that can be employed in the present invention include, but are not limited to: Varisoft 110 (i.e., methyl bis (hydrogenated tallow aminoethyl) 2-hydroxyethyl ammonium methyl sulfate) supplied by Goldschmidt Chemical Company.

In accordance with the present invention, the inventive high-viscosity, low-solids rinse cycle fabric softener formulation includes from about 50 to about 90% by weight of at least one imidazolinium quat and from about 10 to about 50% by weight of said at least one amido amine quat. Preferably, the inventive formulation includes from about 60 to about 90% by weight of at least one imidazolinium quat and from about 10 to about 40% by weight of said at least one amido amine quat, and more preferably, the inventive formulation includes from about 70 to about 90% by weight of at least one imidazolinium quat and from about 10 to about 30% by weight of said at least one amido amine quat The inventive high-viscosity, low-solids rinse cycle fabric softener is formed by blending at least one imidazolinium quat and at least one amido amine quat in the presence of water and at a blending temperature of from about 30° to about 70° C., preferably from about 40° to about 50° C. Continuous stirring occurs throughout the blending period.

The water employed in the present invention in forming the high-viscosity formulation preferably has a conductivity of about 2 $\mu$S/cm or below and a hardness of about 1 ppm $CaCO_3$ or below. The water hardness and conductivity values mentioned above are, however, not critical to the present invention.

It has been found that by employing the above blending conditions, it is possible to form a low-solids rinse cycle fabric softener formulation that has a viscosity of about 500 cps or higher. More preferably, the inventive low-solids rinse cycle fabric softener formulation has a viscosity of from about 800 to about 1200 cps. It is noted that the increased viscosity is achieved in the present invention without the aid of a polymeric thickening agent.

In addition to having a high-viscosity associated therewith, the inventive low-solids rinse cycle fabric softener composition has enhanced softening and non-yellowing properties associated therewith.

The high-viscosity, low-solids rinse cycle fabric softener formulation of the present invention can be added during the rinse cycle of a laundering process wherein any detergent is present in the laundry liquor. That is, the inventive high-viscosity, low-solids rinse cycle fabric softener formulation can be added to a laundering liquor that contains anionic surfactants, non-ionic surfactants, amphoteric surfactants, zwitterionic surfactants or any combinations or mixtures thereof.

Suitable anionic surfactants that can be employed in the detergent composition include water soluble salts, preferably the alklai metal, ammonium and alkylammonium salts of organic sulfuric acid reaction products having in their molecular structure an alkyl group containing from about 10 to about 20 carbon atoms and a sulfonic acid or sulfuric acid ester group. (Included in the term "alkyl" is the alkyl portions of acyl groups).

Some illustrative examples of the above type of anionic surfactants are the sodium and potassium alkyl sulfates, especially those obtained by sulfating higher $C_{8-18}$ alcohols, such as those produced by reducing the glycerides of tallow or coconut oil; and the sodium and potassium alkylbenzene sulfonates in which the alkyl group is straight chained or branched, and the alkyl contains from about 9 to about 15 carbon atoms. The alkylbenzene sulfonates of the former type are described, for example, in U.S. Pat. Nos. 2,220,099 and 2,477,383, the contents of each reference is incorporated herein by reference.

Especially preferred alkylbenzene sulfonates are linear straight chain alkylbenzene sulfonates in which the average number of carbon atoms in the alkyl group is from about 10 to 15, abbreviated as $C_{10-15}$ LAS. The alkali salts, particularly the sodium salts of these anionic surfactants are preferred. Alkylbenzene sulfonates and processes for producing the same are disclosed, for example, in U.S. Pat. Nos. 2,220,099 and 2,477,383.

Other anionic surfactants that can be employed in the detergent composition include alkyl alkoxylated sulfates. These compounds are water-soluble salts or acids having the formula $RO(E)_mSO_3M$ wherein R is an unsubstituted $C_{10-24}$ alkyl or hydroxyalkyl group having a $C_{10-18}$ alkyl or hydroxyalkyl group; E is an ethoxy or propoxy unit; m is greater than zero, preferably m is between about 0.5 and about 6; and M is hydrogen or a water soluble cation which can be, for example, a metal cation (e.g., sodium, potassium, lithium, calcium, magnesium, etc.), ammonium or substituted-ammonium cation. Specific examples of substituted ammonium cations include, but are not limited to: methyl-, ethyl-, dimethyl-, trimethyl-ammonium and quaternary ammonium cations, such as tetramethyl-ammonium, dimethyl piperdinum and cations derived from alkanolamines such as monoethanolamine, diethanolamine and triethlamine, and mixtures thereof.

Illustrative examples of the foregoing alkyl alkoxylated sulfates include: $C_{12-18}$ alkyl polyethoxylate (1.0) sulfate, $C_{12-18}$ alkyl polyethoxylate (2.25) sulfate, $C_{12-18}$ alkyl polyethoxylate (3.0) sulfate, $C_{12-18}$ alkyl polyethoxylate (4.0) sulfate, wherein M is sodium or potassium.

Other anionic surfactants useful in the detergent composition include sodium alkyl glyceryl ether sulfonates, particularly those ethers of higher alcohols derived from tallow and coconut oil; sodium coconut oil fatty acid monoglyceride sulfonates and sulfates.

Still further anionic surfactants include water-soluble salts of esters of alpha-sulfonated fatty acids containing from about 6 to about 20 carbon atoms in the fatty acid portion of the compound and from 1 to about 10 carbon atoms in the ester group; water-soluble salts of 2-acyloxyalkane-1-sulfonic acids containing from about 2 to about 9 carbon atoms in the acyl portion of the compound and from about 9 to about 23 carbon atoms in the alkane moiety; water-soluble salts of olefin and paraffin sulfonates containing from about 12 to about 20 carbon atoms; and beta-alkyloxy alkane sulfonates containing from 1 to about 3 carbon atoms in the alkyl group and from about 8 to about 20 carbon atoms in the alkane moiety.

Typical nonionic surfactants that can be present in the detergent composition include polyethylene, polypropylene and polybutylene oxide condensates of alkyl phenols. Other examples of nonionic surfactants include: condensation products of primary and secondary aliphatic alcohols, alkylpolysaccharides, condensation products of ethylene oxide with a hydrophobic base formed by the condensation of propylene oxide with propylene glycol, condensation products of ethylene oxide with the product resulting from the reaction of propylene oxide and ethylenediamine, and polyhydroxy fatty acid amides.

The detergent may also include any conventional amphoteric or zwitterionic surfactant therein. The use of the inventive high-viscosity, low-solids rinse cycle fabric softener formulation is not limited to a specific type of detergent, but rather the rinse cycle fabric softener formulation of the present invention can be used with any conventional detergent.

In addition to the above ingredients, the detergent composition may also include conventional detergent builders, enzymes, bleaching agents, bleach activators, polymeric soil release agents, chelating agents, soil release and anti-redeposition agents, dispersing agents, optical brighteners, whitening agents, betaines, sultanies and other like components that may be typically used in laundry detergents. Since all these compounds are conventional, a detailed description of the optional components is not provided herein. A detailed description of these detergent components however can be found in WO 98/53034, the contents of which is incorporated herein by reference.

Operational Use:

The high-viscosity, low-solids rinse cycle fabric softener formulation of the present invention is typically added to the rinse cycle of a laundry process utilizing conventional washing temperatures of about 20° C. to about 60° C. and rinsing temperatures of about 10° C. to about 50° C. The rinse cycle fabric softener formulation of the present invention is effective over a wide range of water hardness levels.

The rinse cycle fabric softener of the present invention may be used in laundering operations by adding the formulation to a laundering vessel in amounts that are typically used. Specifically, the inventive rinse cycle formulation of the present invention is used in an amount of from about 20 g to about 120 g solids content of fabric softener with a 3 to 8 pound load of clothing to be washed. The particular amount of fabric softener used in the rinsing cycle is not however critical to the present invention.

The following example is given to illustrate the present invention and to demonstrate some advantages that can be obtained from utilizing the same.

EXAMPLE

In this example, an inventive high-viscosity, low-solids rinse cycle fabric softener formulation was prepared in accordance with the present invention and was compared to fabric softener formulations of the prior art which included ADOGEN 442 (i.e., dihydrogenated tallow dimethylammonium chloride) having 5% solids and a viscosity of about 800 cps (spindle #3 60 rpm), CE1 and CE2, respectively. The inventive blend comprised 80% by weight REWOQUAT W75H (i.e., methyl-1-hydrogenated tallow imidazolinium methyl sulfate) and 20% by weight. VARISOFT 110–75% (methyl bis(hydrogenated tallow aminoethyl) 2-hydroxyethyl ammonium methyl sulphate, modified) and the blend had a 5% solids content and a viscosity of 800 cps associated therewith. All viscosities reported herein were made at 23° C. using a Brookfield spindle #3 at 60 rpm.

Softening

Softening performance of the inventive blend was compared to that of CE1 and CE2 using the following conditions:

Water Temperature=25° C.

Fabric=4 Cotton Towels (240 g), sheets (1.3 kg)

Water Volume=43 L

Water/Fabric Ratio=30/1

Water Type=Tap Water

Softener Dosage=0.15% based on dry fabric weight

Detergent Dosage=None

Drying =Line

Using the above conditions, a panel of six ranked the towels and determined that the inventive blend felt softener to them than either CE1 or CE2.

Yellowing

The effect of yellowing was studied on the same towels as previously used for evaluating the softening performance. The towels were folded in half and left on a bench which was not in direct sunlight for 3 weeks. After this time period, the towels were unfolded to see if the two sides of the fold line were different in color. The yellowing effect was just faintly noticeable; therefore the towels were placed on the bench for an additional 3 weeks. After this 6 week time period, the towels treated with CE1 and CE2 were clearly more yellow than those treated with the inventive blend. The whiteness index was then determined using a HunterLab calorimeter and it was found that the comparative samples had a whiteness index of about 92%, whereas the inventive blend has a whiteness index of about 96%.

While the present invention has been particularly shown and described with respect to preferred embodiments thereof, it will be understood by those skilled in the art that the foregoing and other changes in form and detail may be made without departing from the spirit and scope of the present invention. It is therefore intended that the present invention not be limited to the exact forms described and illustrated, but fall within the scope of the appended claims.

What is claimed is:

1. A high-viscosity, low-solids rinse cycle fabric softener formulation comprising a homogeneous blend of (a) about 50 to about 90% by weight of at least one imidazolinium quaternary ammonium compound; and (b) about 10 to about 50% by weight of at least one amido amine quaternary ammonium compound, wherein said at least one imidazolinium quaternary ammonium compound and said at least one amido amine quaternary ammonium compound do not contain any unsaturated alkyl groups, and are dispersed in water, said homogeneous blend has a solid content of about 10% or less and a viscosity of about 500 cps or greater.

2. The high-viscosity, low-solids rinse cycle fabric softener formulation of claim 1 wherein said at least one imidazolinium quaternary ammonium compound has the following formula:

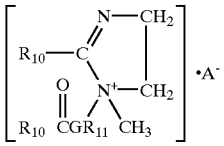

wherein $R_{10}$ is an saturated $C_{11-21}$ alkyl; $R_{11}$ is a divalent $C_{1-6}$ alkyl group; G is O or NH; and A is an anion selected from the group consisting of chloride, bromide, methyl sulfate, ethysulfate, formate, acetate, carbonate, sulfate, and nitrate.

3. The high-viscosity, low-solids rinse cycle fabric softener formulation of claim 2 wherein said at least one imidazolinium quaternary ammonium compound is Varisoft 445.

4. The high-viscosity, low-solids rinse cycle fabric softener formulation of claim 1 wherein said at least one amido amine quaternary ammonium compound has the following formula:

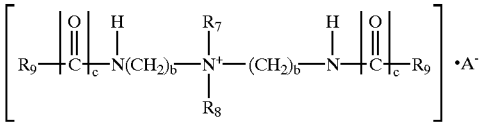

wherein $R_7$ is a $C_{1-4}$ alkyl; $R_8$ is a $C_{1-4}$ alkyl, hydroxyethyl or hydroxypropyl; each $R_9$ is the same or different and is a saturated $C_{7-27}$ alkyl; c is 1; b is 1 to 6; and A is an anion selected from the group consisting of chloride, bromoide, methyl sulfate, ethylsulfate, formate, acetate, carbonate, sulfate, and nitrate.

5. The high-viscosity, low-solids rinse cycle fabric softener formulation of claim 4 wherein said at least one amido amine quaternary ammonium compound is methyl bis (hydrogenated tallow aminoethyl) 2-hydroxyethyl ammonium methyl sulfate.

6. The high-viscosity, low-solids rinse cycle fabric softener formulation of claim 1 wherein said blend comprises from about 60 to about 90% by weight of said at least one imidazolinium quaternary ammonium compound and from about 10 to about 40% by weight of at least said one amido amine quaternary ammonium compound.

7. The high-viscosity, low-solids rinse cycle fabric softener formulation of claim 6 wherein said blend comprises from about 70 to about 90% by weight of said at least one imidazolinium quaternary ammonium compound; and from about 10 to about 30% by weight of at least said one amido amine quaternary ammonium compound.

8. The high-viscosity, low-solids rinse cycle fabric softener formulation of claim 1 wherein said water has a conductivity of about 2 $\mu$S/cm or less and a hardness of about 1 ppm $CaCO_3$ or less.

9. The high-viscosity, low-solids rinse cycle fabric softener formulation of claim 1 wherein said water is tap water.

10. The high-viscosity, low-solids rinse cycle fabric softener formulation of claim 1 further comprising a detergent.

11. The high-viscosity, low-solids rinse cycle fabric softener formulation of claim 10 wherein said detergent comprises at least one surfactant selected from the group consisting of anionic surfactants, non-ionic surfactants. amphoteric surfactants, zwiterionic surfactants, and any combinations or mixtures thereof.

12. A method of preparing a high-viscosity, low-solids rinse cycle fabric softener formulation comprising blending about 50 to about 90% by weight of at least one imidazolinium quaternary ammonium compound with about 10 to about 50% by weight of at least one amido amine quaternary ammonium compound to form a homogeneous blend having a solid content of about 10% or less and a viscosity of about 500 cps or greater, wherein said at least one imidazolinium quaternary ammonium compound and said at least one amido amine quaternary ammonium compound do not contain any unsaturated alkyl groups, and are dispersed in water at a temperature of from about 30° to about 70° C.

13. The method of claim 12 wherein said at least one imidazolinium quaternary ammonium compound has the following formula:

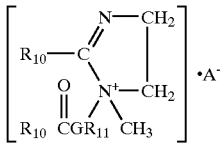

wherein $R_{10}$ is an saturated $C_{11-21}$ alkyl; $R_{11}$ is a divalent $C_{1-6}$ alkyl group; G is O or NH; and A is an anion selected from the group consisting of chloride, bromide, methyl sulfate, ethysulfate, formate, acetate, carbonate, sulfate, and nitrate.

14. The method of claim 13 wherein said at least one imidazolinium quaternary ammonium compound is methyl-1-hydrogenated tallow imidazolinium methyl sulfate.

15. The method of claim 12 wherein said at least one amido amine quaternary ammonium compound has the following formula:

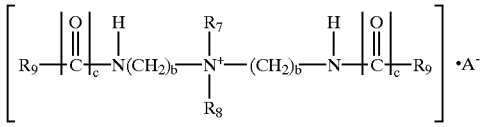

wherein $R_7$ is a $C_{1-4}$ alkyl; $R_8$ is a $C_{1-4}$ alkyl, hydroxyethyl or hydroxypropyl; each $R_9$ is the same or different and is a saturated $C_{7-27}$ alkyl; c is 1; b is 1 to 6; and A is an anion selected from the group consisting of chloride, bromide, methyl sulfate, ethylsulfate, formate, acetate, carbonate, sulfate, and nitrate.

16. The method of claim 14 wherein said at least one amido amine quaternary ammonium compound is Varisoft 110.

17. The method of claim 12 wherein said blend comprises from about 60 to about 90% by weight of said at least one imidazolinium quaternary ammonium compound and from about 10 to about 40% by weight of at least said one amido amine quaternary ammonium compound.

18. The method of claim 17 wherein said blend comprises from about 70 to about 90% by weight of said at least one imidazolinium quaternary ammonium compound; and from about 10 to about 30% by weight of at least said one amido amine quaternary ammonium compound.

19. The method of claim 12 wherein said water has a conductivity of about 2 $\mu$S/cm or less and a hardness of about 1 ppm $CaCO_3$ or less.

20. The method of claim 12 wherein said water is tap water.

21. The method of claim 12 wherein said blending is carried out with continuous stirring.

22. The method of claim 12 wherein said temperature is from about 40° to about 50° C.

* * * * *